US011821690B2

(12) United States Patent
Cao et al.

(10) Patent No.: US 11,821,690 B2
(45) Date of Patent: Nov. 21, 2023

(54) SINGLE CRYSTAL FURNACE

(71) Applicant: ZHEJIANG JINGSHENG M & E CO., LTD, Shaoxing (CN)

(72) Inventors: Jianwei Cao, Shaoxing (CN); Liang Zhu, Shaoxing (CN); Linjian Fu, Shaoxing (CN); Gangfei Ye, Shaoxing (CN); Junfu Ni, Shaoxing (CN)

(73) Assignee: ZHEJIANG JINGSHENG M & E CO., LTD, Shaoxing (CN)

( * ) Notice: Subject to any disclaimer, the term of this patent is extended or adjusted under 35 U.S.C. 154(b) by 0 days.

(21) Appl. No.: 17/706,597

(22) Filed: Mar. 29, 2022

(65) Prior Publication Data

US 2023/0243588 A1 Aug. 3, 2023

Related U.S. Application Data

(63) Continuation of application No. PCT/CN2022/075166, filed on Jan. 30, 2022.

(51) Int. Cl.

| | |
|---|---|
| ***F27D 1/18*** | (2006.01) |
| *F27D 1/00* | (2006.01) |
| *F27D 21/00* | (2006.01) |
| *F27D 99/00* | (2010.01) |

(52) U.S. Cl.

CPC .... *F27D 1/1808* (2013.01); *F27D 2001/0066* (2013.01); *F27D 2001/1841* (2013.01); *F27D 2021/0057* (2013.01); *F27D 2099/0083* (2013.01)

(58) Field of Classification Search

CPC ..... F27D 1/1808

See application file for complete search history.

(56) References Cited

U.S. PATENT DOCUMENTS 4,588,376 A * 5/1986 Tyson ..... F27D 21/0014 374/154

FOREIGN PATENT DOCUMENTS

| | | | |
|---|---|---|---|
| CN | 203462173 U | * | 3/2014 |
| CN | 204174307 U | * | 2/2015 |
| CN | 204174311 U | * | 2/2015 |
| CN | 204918837 U | | 12/2015 |
| CN | 208717463 U | | 4/2019 |
| CN | 208717467 U | | 4/2019 |
| CN | 210684004 U | * | 6/2020 |
| CN | 215251325 U | * | 12/2021 |
| GB | 1284017 A | | 8/1972 |

OTHER PUBLICATIONS

International Search Report of PCT/CN2022/075166.

* cited by examiner

*Primary Examiner* — Jason Lau

(57) ABSTRACT

The present disclosure relates to a single crystal furnace, which includes a main furnace body, an accessory furnace body, a furnace cover, and a driving component. The accessory furnace body is provided with a first connecting member. The furnace cover is provided with a second connecting member. The driving component can drive the first connecting member or the second connecting member to move, so as to match the first connecting member with the second connecting member, and connect the accessory furnace body with the furnace cover.

5 Claims, 5 Drawing Sheets

SINGLE CRYSTAL FURNACE

CROSS-REFERENCE TO RELATED APPLICATION

This application is a continuation application of International Application No. PCT/CN2022/075166 filed on Jan. 30, 2022, and titled "SINGLE CRYSTAL FURNACE" in the China National Intellectual Property Administration, and the content of which are hereby incorporated by reference.

TECHNICAL FIELD

The present disclosure relates to production of single crystal furnace, in particular to a single crystal furnace.

BACKGROUND

A single crystal furnace is a device that can melt polycrystalline materials such as polycrystalline silicon with a graphite heater in an inert gas environment, and grow a dislocation-free single crystal by the Czochralski method. The single crystal furnace generally includes a main furnace body and an accessory furnace body. Raw material of crystalline silicon can be heated in the main furnace, and a formed silicon crystal can be generated by the Czochralski method in the accessory furnace body. After forming in the accessory furnace body, the accessory furnace body can be separated from the single crystal furnace and transferred to other equipment for subsequent processing.

As shown in FIG. 1, in the conventional art, the accessory furnace body of the single crystal furnace and a furnace cover of the single crystal furnace include a bracket, respectively. Both the accessory furnace body and the furnace cover are provided with a rotating lifting mechanism, respectively. Thus, a conventional single crystal furnace has a complex structure and a high cost. In addition, when the conventional single crystal furnace is in operation, the accessory furnace body must be raised to a certain height before the furnace cover can be lifted. When a lifting distance of the accessory furnace body is certain, a lifting distance of the furnace cover will also be limited, so that the furnace cover cannot reach the same lifting distance as the accessory furnace body. In order to ensure that the furnace cover has a sufficient lifting distance, the single crystal furnace must be made higher, which will cause a stability of the single crystal furnace to deteriorate.

SUMMARY

In view of above, it is necessary to provide a single crystal furnace for solving the above technical problem.

A signal crystal furnace includes a main furnace body, an accessory furnace body and a furnace cover. The furnace cover is detachably disposed between the main furnace body and the accessory furnace body.

The single crystal furnace further includes a driving component. The accessory furnace body is provided with a first connecting member. The furnace cover is provided with a second connecting member. The driving component is configured to drive the first connecting member or the second connecting member to move, so that the first connecting member is matched with the second connecting member, and the accessory furnace body is connected with the furnace cover as an integrity structure.

It should be understood that by designing a structure including the first connecting member, the second connecting member and the driving component, the driving component can automatically control the first connecting member to match with the second connecting member, so that the accessory furnace body can be connected to the furnace cover according to usage requirements. Therefore, the accessory furnace body can selectively drive the furnace cover to simultaneously lift or fall according to requirements, so that the single crystal furnace can drive the accessory furnace body or simultaneously drive the accessory furnace body and the furnace cover to move via one bracket on the accessory furnace body. Thus, a structure of the single crystal furnace can be simplified, and a cost of the single crystal furnace can be lowered. In addition, the accessory furnace body and the furnace cover can be lifted at the same time. Therefore, a lifting distance of the accessory furnace body and a lifting distance of the furnace cover can be the same, and a height of the single crystal furnace can be lowered and the stability of the single crystal furnace in operation can be improved.

In some embodiments, the first connecting member includes a hook, and the hook is rotatably installed the accessory furnace body. In addition, the second connecting member includes an anchor plate, which is capable of rotating towards a direction of the anchor plate and hooking the anchor plate under action of driving component.

It should be understood that the hook and the anchor plate can be the first connecting member and the second connecting member in some embodiment, respectively.

In some embodiments, the hook is provided with an inclined protrusion, and the anchor plate is provided with a limiting groove. The hook is capable of driving the inclined protrusion to insert into the limiting groove and abut against a bottom surface of the limiting groove.

It should be understood that by designing the inclined protrusion and the limiting groove, the hook can match with the anchor plate via the inclined protrusion, so as to ensure connecting stability between the hook and the anchor plate.

In some embodiments, the first connecting member includes a plurality of hooks, and the plurality of hooks are disposed on the accessory furnace body at intervals.

It should be understood that by designing the plurality of hooks, the connecting stability between the hook and the anchor plate can be further ensured.

In some embodiments, the driving component includes a driving motor configured to drive the hook to rotate relative to the accessory furnace body.

It should be understood that by designing the driving motor as the driving component, the hook can be controlled to automatically rotate in some embodiments.

In some embodiments, the first connecting member includes a circular plate rotatably disposed on the accessory furnace body, and the circular plate is provided with an irregular-shaped hole. The second connecting member includes an irregular-shaped fastener, which matches with the irregular-shaped hole and is capable of rotating along an inner wall of the irregular-shaped hole in the irregular-shaped hole, so as to selectively limit the circular plate along an axis direction of the circulate plate.

It should be under stood that the circular plate and the irregular-shaped fastener can be the first connecting member and the second connecting member in some embodiments, respectively.

In some embodiments, the irregular-shaped hole includes a narrow part and a broad part, and the irregular-shaped fastener penetrates through the irregular-shaped hole. An outer diameter of a part of the irregular-shaped fastener stretching out of the irregular-shaped hole is greater than a diameter of the narrow part, and smaller than a diameter of the broader section.

It should be understood that by designing the above structure, the irregular-shaped fastener and the circular plate can be selectively limited along the axis direction of the circulate plate in some embodiments.

In some embodiments, the driving component includes an electric motor, a driving gear, and an arc-shaped toothed plate. The arc-shaped toothed plate is disposed on a plate surface of the circular plate and matches with the driving gear, allowing the electric motor to drive the circular plate to rotate relative to the accessory furnace body via gear matching between the driving gear and the arc-shaped toothed plate.

It should be understood by the electro motor, the driving gear and the arc-shaped toothed plate, single crystal furnace of another embodiment of the driving component can be made.

In some embodiments, the single crystal furnace further includes a balancing pulley. The balancing pulley and the arc-shaped toothed plate are symmetrically disposed on the circular plate, and the balancing pulley abuts against the circular plate.

It should be understood that by designing the balancing pulley, the balancing pulley can be used to balance a radial force on the circular plate from the arc-shaped toothed plate while the single crystal furnace is in operation, so as to ensure mounting stability of the circular plate on the accessory furnace body.

In some embodiments, the single crystal furnace further includes a position sensor, which is configured to detect positions of the first connecting member and/or the second connecting member and generate feedback signals.

It should be understood that by designing the position sensor, while the single crystal furnace is in operation, states of the first connecting member and the second connecting member can be estimated by the feedback signals generated by the position sensor, so as to judge whether the accessory furnace body is connected to the furnace cover or not. Therefore, the accessory furnace body can be automatically connected to the furnace cover according to usage requirements while the single crystal furnace is in operation.

In the figures, 10 represents a main furnace body; 20 represents an accessory furnace body; 201 represents a balancing pulley; 21 represents a first connecting member; 211 represents a hook; 2111 represents a inclined protrusion; 212 represents a circular plate; 2121 represents an irregular-shaped hole; 21211 represents a narrow part; 21212 represents a broad part; 2122 represents an inner wall of the irregular-shaped hole; 2123 represents a plate surface; 22 represents a bracket; 30 represents a furnace cover; 31 represents a the second connecting member; 311 represents an anchor plate; 3111 represents a limiting groove; 3112 represents a bottom surface; 312 represents an irregular-shaped fastener; 40 represents a driving component; 41 represents an electric motor; 42 represents a driving gear; 43 represents an arc-shaped toothed plate; and 50 represents a position sensor.

DETAILED DESCRIPTION

The technical solutions in the embodiments of the present disclosure will be clearly and completely described below with reference to the accompanying drawings in the embodiments of the present disclosure. Obviously, the described embodiments are only a part of, but not all, embodiments of the present disclosure. Based on the embodiments of the present disclosure, all other embodiments obtained by one of ordinary skill in the art without creative efforts shall fall within the protection scope of the present disclosure.

It should be noted that when an element is referred to as being "disposed on" another element, it can be directly disposed on the other element or an intervening element may also be present. When an element is referred to as being "disposed on" another element, it can be directly disposed on the other element or intervening elements may also be present. When an element is referred to as being "fixed" to another element, it can be directly fixed to the other element or intervening elements may also be present.

Unless otherwise defined, all technical and scientific terms used herein have the same meaning as commonly understood by one of ordinary skill in the art to which this disclosure belongs. The terms used in the description of the present disclosure are for the purpose of describing specific embodiments only, and are not intended to limit the present disclosure. As used herein, the term "and/or" includes any and all combinations of one or more of the associated listed items.

Figure 1:
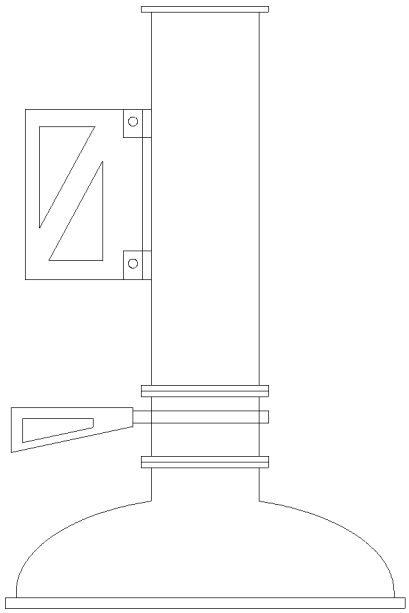
FIG. 1 is a structural schematic diagram of a single crystal furnace in the conventional art.
Figure 2:
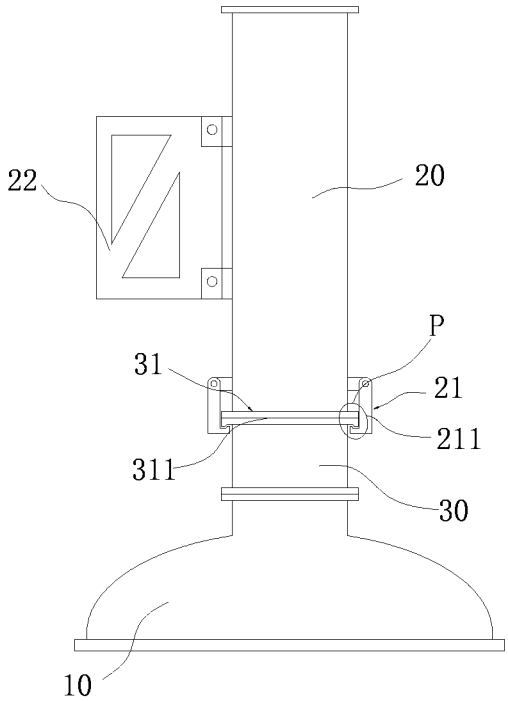
FIG. 2 is a structural schematic diagram of a single crystal furnace in a first embodiment of the present disclosure.
Figure 4:
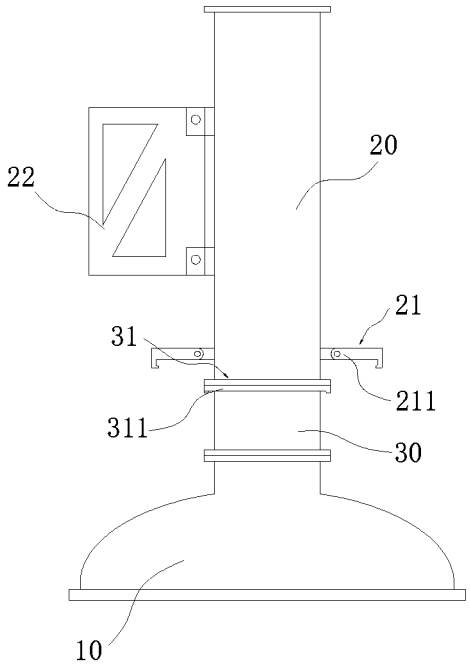
FIG. 4 is a structural schematic diagram of the single crystal furnace in a first embodiment of the present disclosure in another state.

Referring to FIG. 2 and FIG. 4, in some embodiments of the present disclosure, the single crystal furnace can include a main furnace body 10, an accessory furnace body 20 and a furnace cover 30.

The furnace cover 30 can be detachably disposed between the main furnace body 10 and the accessory furnace body 20.

In the present disclosure, the single crystal furnace can further include a driving component 40. The accessory furnace body 20 can be provided with a first connecting member 21. The furnace cover 30 can be provided with a second connecting member 31. The driving component 40 can be configured to drive the first connecting member 21 or the second connecting member 31 to move, so that the first connecting member 21 can be matched with the second connecting member 31, and the accessory furnace body 20 can be connected with the furnace cover 30 as an integrity structure. That is, when the single crystal furnace of the present disclosure works, the driving component 40 can automatically control the first connecting member 21 to match with the second connecting member 31, so that the accessory furnace body 20 can be connected to the furnace cover 30 according to usage requirements. That is, the accessory furnace body 20 and the furnace cover 30 can be automatically connected together. Therefore, while the single crystal furnace is in operation, the accessory furnace body 20 can drive the furnace cover 30 to simultaneously lift or fall according to requirements.

It could be understood that in the present disclosure, by designing the single crystal furnace having the above structure, the single crystal furnace can drive the accessory furnace body 20 or simultaneously drive the accessory furnace body 20 and the furnace cover 30 to move via one bracket 22 on the accessory furnace body 20. Thus, a structure of the single crystal furnace can be simplified, and a cost of the single crystal furnace can be lowered. In addition, the accessory furnace body 20 and the furnace cover 30 can be lifted at the same time. Therefore, a lifting distance of the accessory furnace body 20 and a lifting distance of the furnace cover 30 can be the same, therefore a height of the single crystal furnace can be lowered and is in operation stability of the single crystal furnace can be improved.

In addition, it should be noted that the single crystal furnace further can include a position sensor 50, which can detect positions of the first connecting member 21 and/or the second connecting member 31 and generate feedback signals. Therefore, when the single crystal furnace works, states of the first connecting member 21 and the second connecting member 31 can be estimated by the feedback signals generated by the position sensor 50, so as to judge whether the accessory furnace body 20 is connected to the furnace cover 30 or not. Therefore, the accessory furnace body 20 can be automatically connected to the furnace cover 30 according to usage requirements while the single crystal furnace is in operation. In some embodiments, the position sensor 50 can be a microswitch, a proximity switch and the like, which are described in details herein.

Figure 3:
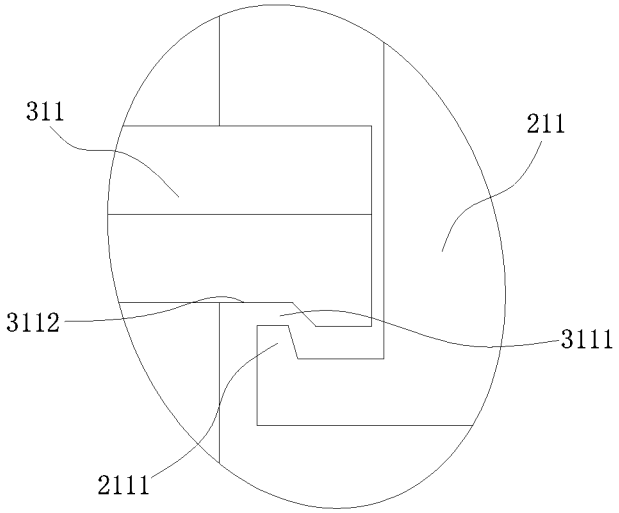
FIG. 3 is an enlarged figure at P portion in FIG. 2.

Referring to FIG. 2 to FIG. 4, in a first embodiment of the present disclosure, the first connecting member 21 can be a hook 211. The hook 211 can be rotatably installed on the accessory furnace body 20. The second connecting member 31 can be an anchor plate 311, which can rotate towards a direction of the anchor plate 311 and hook the anchor plate 311. Thus, a single crystal furnace including a first connecting member 21 and a second connecting member 31 in some embodiments of the present disclosure can be made. In some embodiments, it should be noted that the first connecting member 21 and the second connecting member 31 are not limited to those shown in the figures. For one of ordinary skill in the art, the first connecting member 21 can be an anchor plate, and the second connecting member 31 can be a hook, which will not be described in details herein.

In some embodiments, the hook 211 can be provided with an inclined protrusion 2111, and the anchor plate 311 can be provided with a limiting groove 3111. The hook 211 can drive the inclined protrusion 2111 to insert into the limiting groove 3111 and abut against a bottom surface of the limiting groove 3111. The hook 211 can match with the anchor plate 311 via the inclined protrusion 2111, so as to ensure connecting stability between the hook 211 and the anchor plate 311.

In some embodiments, the first connecting member 21 can be a plurality of hooks 211. The plurality of hooks 211 can be disposed on the accessory furnace body 20 at intervals. In some embodiments, a number of the hook 211 can be two. The two hooks 211 can be symmetrically disposed on the accessory furnace body 20. Thus, the hook 211 and the accessory furnace body 20 in some embodiments of the present disclosure can be made. Therefore, connecting stability between the hook 211 and the anchor plate 311 can be further ensured.

In the first embodiment, the driving component 40 can be a driving motor, which can drive the hook 211 to rotate relative to the accessory furnace body 20. Specifically, the hook 211 and a shaft of the driving motor can be circumferentially limited, so as to obtain the driving component 40 in some embodiments of the present disclosure, and automatically control rotation of the hook 211. Of course, it should be noted that the driving component 40 is not limited to driving motor. For one of ordinary skill in the art, the driving component 40 can be a rotating cylinder, or the driving motor can be connected to the hook 211 via a transmission structure, which is not described in details herein.

Figure 5:
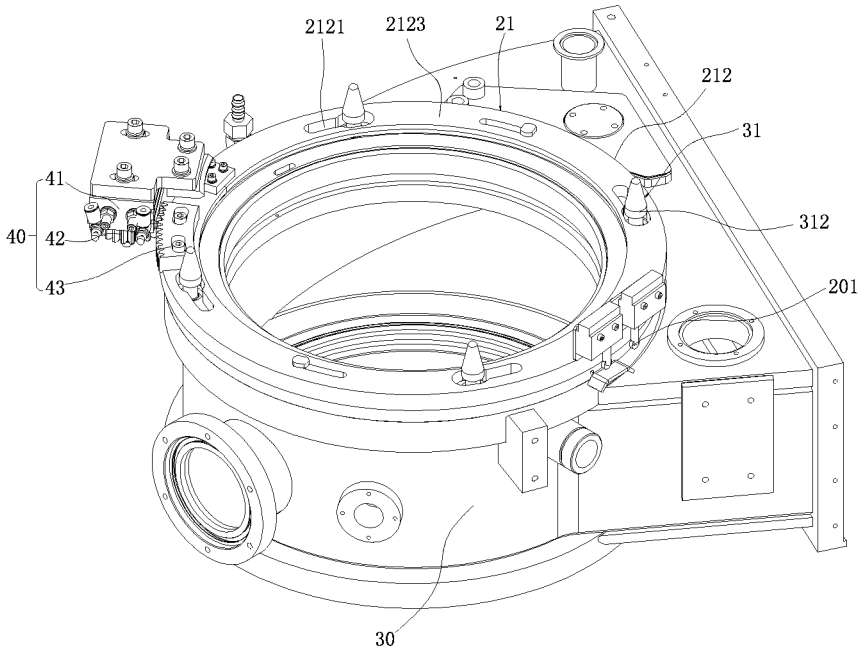
FIG. 5 is a partial structural schematic diagram of a single crystal furnace in a second embodiment of the present disclosure.
Figure 6:
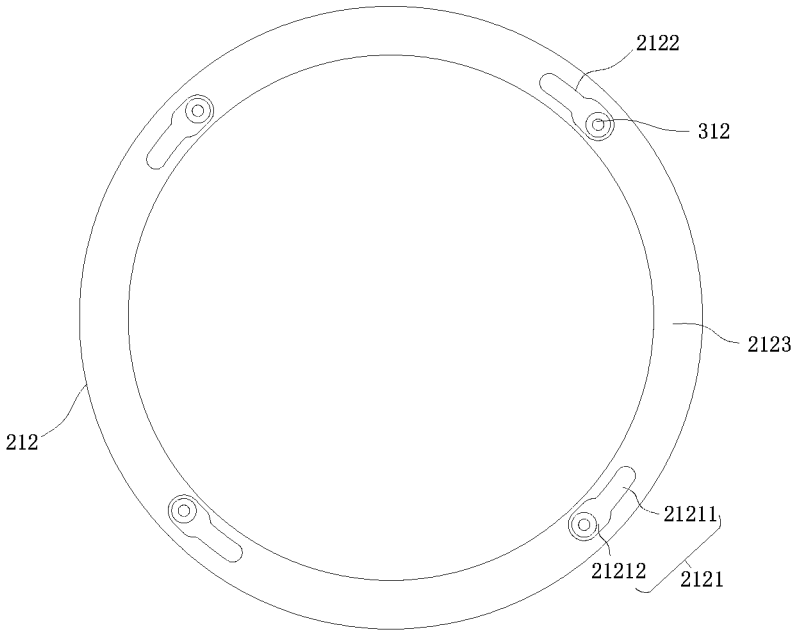
FIG. 6 is a structural schematic diagram of a circular plate and an irregular-shaped fastener in a discrete state in a second embodiment of the present disclosure.
Figure 7:
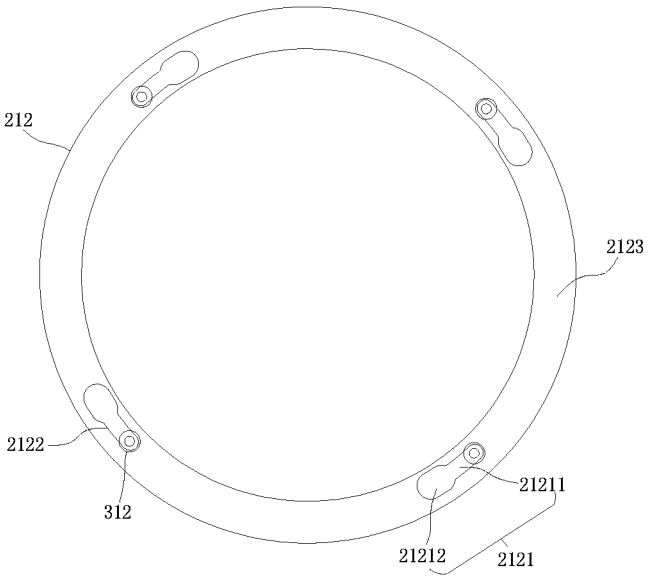
FIG. 7 is a structural schematic diagram of the circular plate and the irregular-shaped fastener in a connecting state in a second embodiment of the present disclosure.
Figure 8:
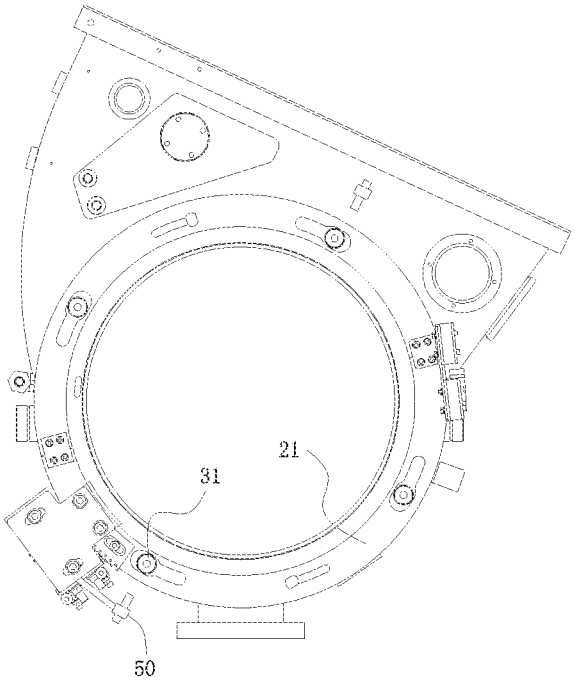
FIG. 8 is a structural schematic diagram of a position sensor in an embodiment of the present disclosure.
Figure 9:
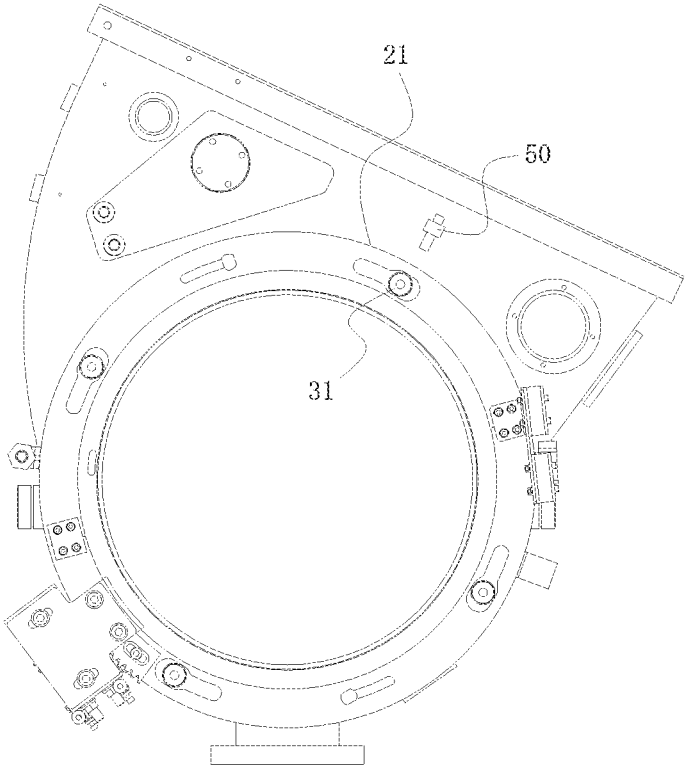
FIG. 9 a structural schematic diagram of a position sensor in another embodiment of the present disclosure.

Referring to FIG. 5 to FIG. 7, in a second embodiment of the present disclosure, the first connecting member 21 can be a circular plate 212, which can be rotatably disposed on the accessory furnace body 20, and the circular plate 212 can be provided with an irregular-shaped hole 2121. The second connecting member 31 can be an irregular-shaped fastener 312, which can match with the irregular-shaped hole 2121 and can rotate along an inner wall of the irregular-shaped hole 2121 in the irregular-shaped hole 2121, so as to selectively limit the circular plate 212 along an axis direction of the circulate plate. Thus, the first connecting member 21 and the second connecting member 31 in some embodiments can be obtained. Of course, it should be noted that the first connecting member 21 and the second connecting member 31 are not limited to those shown in the figures. For one of ordinary skill in the art, the first connecting member 21 can be an irregular-shaped fastener, and the second connecting member 31 can be a circular plate, which are not described in details herein.

In some embodiments, the irregular-shaped hole 2121 can include a narrow part 21211 and a broad part 21212, and the irregular-shaped fastener 312 can penetrate through the irregular-shaped hole 2121. An outer diameter of a part of the irregular-shaped fastener 312 stretching out of the irregular-shaped hole 2121 can be greater than a diameter of the narrow part 21211, and can be smaller than a diameter of the broad part 21212. Thus, in some embodiments, the irregular-shaped fastener 312 and the circular plate 212 can be selectively limited along the axis direction of the circulate plate. Of course, it should be noted that an outer diameter of the part of the irregular-shaped fastener 312 stretching out of the irregular-shaped hole 2121 can be equal to the diameter of the broad part 21212.

It should be noted that when the irregular-shaped fastener 312 is disposed in the narrow part 21211 of the irregular-shaped hole 2121, the irregular-shaped fastener 312 and the circular plate 212 can be limited along the axis direction of the circulate plate. That is, the accessory furnace body 20 and the furnace cover 30 can be connected, so that the accessory furnace body 20 can drive the furnace cover 30 to be simultaneously lifted. When the irregular-shaped fastener 312 is disposed in the broad part 21212 of the irregular-shaped hole 2121, limitation between the irregular-shaped fastener 312 and the circular plate 212 along the axis direction of the circulate plate can be relieved. That is, the accessory furnace body 20 can be separated from the furnace cover 30, so that the accessory furnace body can be independently lifted by the bracket 22 when the single crystal furnace works.

In some embodiments, the driving component 40 can include an electric motor 41, a driving gear 42, and an arc-shaped toothed plate 43. The arc-shaped toothed plate 43 can be disposed on a plate surface 2123 of the circular plate 212 and match with the driving gear 42, allowing the electric motor 41 to drive the circular plate 212 to rotate relative to the accessory furnace body 20 via gear matching between the driving gear 42 and the arc-shaped toothed plate 43. Thus, the driving component 40 in some embodiments can be obtained.

Furthermore, the single crystal furnace in the present disclosure can further include a balancing pulley 201. The balancing pulley 201 and the arc-shaped toothed plate 43 can be symmetrically disposed on the circular plate 212, and the balancing pulley 212 can abut against the circular plate 212. The balancing pulley 212 can be used to balance a radial force on the circular plate 212 from the arc-shaped toothed plate 43 while the single crystal furnace is in operation, so as to ensure mounting stability of the circular plate 212 on the accessory furnace body 20.

The technical features of the above-described embodiments may be combined in any combination. For the sake of brevity of description, not all possible combinations of the technical features in the above embodiments are described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. As long as they are within the essential spirit of the present disclosure, appropriate changes and changes made to the above embodiments all fall within the scope of protection of the present disclosure.

We claim:

1. A single crystal furnace, comprising a main furnace body, an accessory furnace body and a furnace cover, wherein the furnace cover is detachably disposed between the main furnace body and the accessory furnace body; wherein the single crystal furnace further comprises a driving component, the accessory furnace body is provided with a first connecting member, the furnace cover is provided with a second connecting member, the driving component is configured to drive the first connecting member or the second connecting member to move, so that the first connecting member is matched with the second connecting member, and the accessory furnace body is connected with the furnace cover as an integral structure, the first connecting member comprises a hook, the hook is rotatably installed on the accessory furnace body; and the second connecting member comprises an anchor plate, and the hook is capable of rotating towards a direction of the anchor plate and hooking the anchor plate under action of the driving component.

2. The single crystal furnace of claim 1, wherein the hook is provided with an inclined protrusion, the anchor plate is provided with a limiting groove, the hook is capable of driving the inclined protrusion to insert into the limiting groove and abut against a bottom surface of the limiting groove.

3. The single crystal furnace of claim 1, wherein the first connecting member comprises a plurality of hooks, and the plurality of hooks are disposed on the accessory furnace body at intervals.

4. The single crystal furnace of claim 1, wherein the driving component comprises a driving motor configured to drive the hook to rotate relative to the accessory furnace body.

5. The single crystal furnace of claim 1, wherein the single crystal furnace further comprises a position sensor, which is configured to detect positions of the first connecting member and/or the second connecting member and generate feedback signals.

* * * * *